US007331830B2

(12) United States Patent
Minich

(10) Patent No.: US 7,331,830 B2
(45) Date of Patent: Feb. 19, 2008

(54) HIGH-DENSITY ORTHOGONAL CONNECTOR

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/368,211

(22) Filed: Mar. 3, 2006

(65) Prior Publication Data

US 2007/0207641 A1 Sep. 6, 2007

(51) Int. Cl.
*H01R 11/22* (2006.01)

(52) U.S. Cl. ..... 439/857

(58) Field of Classification Search ..... 439/857, 439/608, 856

See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 3,115,379 | A | 12/1963 | McKee | 439/290 |
| 3,827,005 | A | 7/1974 | Friend | 339/258 |
| 4,030,792 | A | 6/1977 | Fuerst | 339/17 |
| 4,898,539 | A | 2/1990 | Glover et al. | 439/81 |
| 4,900,271 | A | 2/1990 | Colleran et al. | 439/595 |
| 5,004,426 | A | 4/1991 | Barnett | 439/82 |
| 5,575,688 | A | 11/1996 | Crane, Jr. | 439/660 |
| 5,634,821 | A | 6/1997 | Crane, Jr. | 439/660 |
| 5,637,019 | A | 6/1997 | Crane, Jr. et al. | 439/677 |
| 5,980,321 | A | 11/1999 | Cohen et al. | 439/608 |
| 6,116,926 | A | 9/2000 | Ortega et al. | 439/108 |
| 6,179,663 | B1 | 1/2001 | Bradley et al. | 439/608 |
| 6,227,882 | B1 | 5/2001 | Ortega et al. | 439/101 |
| 6,293,827 | B1 | 9/2001 | Stokoe | 439/608 |
| 6,299,483 | B1 | 10/2001 | Cohen et al. | 439/608 |
| 6,302,711 | B1 | 10/2001 | Ito | 439/83 |
| 6,328,602 | B1 | 12/2001 | Yamasaki et al. | 439/608 |
| 6,379,188 | B1 | 4/2002 | Cohen et al. | 439/608 |
| 6,506,076 | B2 | 1/2003 | Cohen et al. | 439/608 |
| 6,540,522 | B2 | 4/2003 | Sipe | 439/61 |
| 6,572,409 | B2 | 6/2003 | Nitta et al. | 439/608 |
| 6,672,907 | B2 | 1/2004 | Azuma | 439/682 |
| 6,692,272 | B2 | 2/2004 | Lemke et al. | 439/108 |
| 6,695,627 | B2 | 2/2004 | Ortega et al. | 439/78 |
| 6,736,664 | B2 | 5/2004 | Ueda et al. | 439/423 |
| 6,746,278 | B2 | 6/2004 | Nelson et al. | 439/608 |
| 6,749,439 | B1 | 6/2004 | Potter et al. | 439/65 |
| 6,764,341 | B2 | 7/2004 | Lappoehn | 439/608 |
| 6,808,420 | B2 | 10/2004 | Whiteman, Jr. et al. | 439/608 |
| 6,843,686 | B2 | 1/2005 | Ohnishi et al. | 439/608 |

(Continued)

*Primary Examiner*—Phuong Dinh
(74) *Attorney, Agent, or Firm*—Woodcock Washburn LLP

(57) ABSTRACT

A high-density orthogonal connector is disclosed and may include electrical contacts that are configured to receive contacts from an orthogonal header connector while minimizing signal skew and signal reflection. The electrical contacts in the connector may define contact pairs (e.g., differential signal pairs). Each contact pair may include a lead portion and a mating interface that extends from the lead portion. The lead portions of the contact pair may define a first plane. One contact of the contact pair defines a first mating interface defining a second plane and the other contact in the contact pair defines a second mating interface defining a third plane. The second plane and the third plane may be both substantially parallel to and offset from the first plane in opposite directions. The contact pair may be configured such that the overall length of each contact within the pair may be substantially the same.

22 Claims, 12 Drawing Sheets

U.S. PATENT DOCUMENTS 6,851,980 B2 2/2005 Nelson et al. ..... 439/608
6,893,686 B2 5/2005 Egan ..... 427/496
6,913,490 B2 7/2005 Whiteman, Jr. et al. .... 439/608
6,918,789 B2 7/2005 Lang et al. ..... 439/608
6,981,883 B2 1/2006 Raistrack et al. ..... 439/74
7,021,975 B2 4/2006 Lappohn ..... 439/733.1
7,094,102 B2 8/2006 Cohen et al. ..... 439/608
7,108,556 B2 9/2006 Cohen et al. ..... 439/608
2004/0235321 A1 11/2004 Mizumura et al. ..... 439/92
2005/0032401 A1 2/2005 Kpbayashi ..... 439/76.2
2005/0170700 A1 8/2005 Shuey et al. ..... 439/701
2005/0196987 A1 9/2005 Shuey et al. ..... 439/108
2005/0215121 A1 9/2005 Tokunaga ..... 439/608
2005/0227552 A1 10/2005 Yamashita et al. ..... 439/862
2006/0024983 A1 2/2006 Cohen et al. ..... 439/61
2006/0068641 A1 3/2006 Hull et al. ..... 439/608
2006/0073709 A1 4/2006 Reid ..... 439/65
2006/0228912 A1 10/2006 Morlion et al. ..... 439/65
2006/0232301 A1 10/2006 Morlion et al. ..... 326/126

HIGH-DENSITY ORTHOGONAL CONNECTOR

CROSS REFERENCE TO RELATED APPLICATIONS

The present application is related by subject matter to U.S. patent application Ser. No. 11/367,784, U.S. patent application Ser. No. 11/367,745, and U.S. patent application Ser. No. 11/367,744, the contents of each of which are hereby incorporated by reference in their entireties.

FIELD OF THE INVENTION

Generally, the invention relates to orthogonal connectors. More particularly, the invention relates to high-density orthogonal connectors having pairs of electrical contacts that have minimal signal skew and a substantially constant differential impedance profile that may be matched to a system impedance.

BACKGROUND OF THE INVENTION

An electronic device, such as a computer, for example, may include conductive traces and/or electronic components mounted on printed circuit boards (PCBs), such as daughter cards, backplanes, midplanes, motherboards, and the like. The PCBs may be interconnected to transfer power and data signals throughout the system. In orthogonal PCB applications, a header connector may be electrically coupled to each side of a midplane circuit board through via holes. The via holes on each side of the midplane may be electrically coupled to one another. The header connector on one side of the midplane may be rotated 90 degrees with respect to the header connector on the opposite of the midplane. Each header connector may be electrically coupled to a right-angle connector, which may be electrically coupled to a daughter card, for example. The daughter cards may be oriented orthogonally to one another. For example, the daughter card on one side of the midplane may be oriented horizontally and the daughter card on the opposite side of the midplane may be oriented vertically.

Right-angle connectors are often used to electrically couple PCBs in orthogonal applications. Right-angle connectors may have electrical contacts that define one or more angles. The length of each electrical contact may depend on its respective location in the connector and on the number and/or degree of its angles. Consequently, some or all of the electrical contacts in the right-angle connector may have different lengths. This may cause the end-to-end propagation time of each electrical contact to vary, thereby resulting in signal skew.

Signal skew may be problematic for applications that rely on differential signals, for example. In such applications, a differential signal may be carried on two conductors (i.e., a differential signal pair of electrical contacts). The signal value may be the difference between the individual voltages on each conductor. If the end-to-end propagation time on one conductor is shorter or longer than the other, the signals on each conductor may be skewed. Thus, right-angle connectors may exhibit an undesirable level of signal skew and may be unsuitable for applications that utilize differential signals, for example.

It many connector applications, it is also often desirable to increase the signal contact density of the connector in order to reduce connector size. In addition, it may be desirable to minimize the level of signal reflection that can result when the connector is electrically coupled to a PCB. Signal reflection may occur when the differential impedance between the electrical contacts in a differential signal pair is not matched to the system impedance. Furthermore, signal reflection may occur when there are variations in differential impedance along the length of the electrical contacts.

Therefore, a need exists for a high-density orthogonal connector with electrical contacts that exhibit minimal signal skew and signal reflection.

SUMMARY OF THE INVENTION

A high-density orthogonal connector is disclosed and claimed herein. The electrical contacts in the connector may be configured to receive contacts from an orthogonal header connector while minimizing signal skew and signal reflection. The electrical contacts in the orthogonal connector may include differential signal pairs or single-ended signal contacts. For example, the orthogonal connector may include a first differential signal pair positioned in a first column along a first row of contacts and a second differential signal pair positioned adjacent to the first signal pair in the first column along a second row of contacts. The orthogonal connector may be devoid of any electrical shielding and/or ground contacts.

The electrical contacts in the connector may be configured such that each contact in a contact pair (e.g., differential signal pair) may include a lead portion and a mating interface. According to one embodiment, the mating interface of each electrical contact may include tines, which may form a cross-sectional L-shaped tine. The lead portion and at least a portion of a first tine of the first electrical contact may define a first plane and at least a portion of a second tine may defines a second plane. The second plane may be substantially perpendicular to the first plane. The lead portion and at least a portion of a first tine of the second electrical contact may be in a plane that is parallel to the first plane. At least a portion of a second tine may defines a third plane. The third plane may be substantially perpendicular to the first plane.

As such, the transition between the first and second tines within a mating interface may be defined by a transition portion, which may include a radius. The transition portion may be formed, for example, by twisting the mating interface along the axial length of the first tine and a portion of the second tine such that the tines are rotated out of (e.g., rotated substantially 90 degrees with respect to) the first plane.

The second plane and the third plane may be parallel to and offset from the first plane in opposite directions. For example, the mating interfaces in each contact pair may be twisted axially (e.g., bent over) in opposite directions to the respective offset planes. In addition, the contact pair may be configured such that the overall length of each contact within the pair may be substantially the same.

The first and second electrical contact of the pair of electrical contacts may be symmetrical and the second electrical contact in each pair may be rotated substantially 180 degrees with respect to the first electrical contact. As such, the second tine of the first electrical contact extends in an opposite direction and is offset from the second tine of the second electrical contact of the pair of electrical contacts.

Each mating interface may include tines that define a slot therebetween. The tines may also define opposing protrusion members that may extend into the slot. A gap may be defined between the protrusion members. It will be appreciated that the mating interface has some ability to flex and that the gap may be smaller than the width of a corresponding male contact when the mating interface is not engaged with the male contact and may enlarge when the mating interface receives a contact. Therefore, the protrusion members may exert a force against each opposing side of the male contact, thereby mechanically and electrically coupling the mating interface to the male contact. Preferably, a force is applied at the same point on opposing sides of the male contact such that the mating interface may exert minimal torque on the male contact.

Each electrical contact may also include a base portion at an opposite end from the mating interfaces. The base portion may jog away from the lead portion of the electrical contact. The base portion may include a terminal end, which may interface with, for example, a PCB. The terminal ends may be offset from and extend in substantially the same direction as at least a portion of lead portion. The terminal ends of adjacent electrical contacts may be offset in opposite directions from one another.

The orthogonal connector may also include novel contact configurations for reducing insertion loss and maintaining substantially constant impedance along the lengths of contacts. The use of air as the primary dielectric to insulate the contacts may result in a lower weight connector that is suitable for use in various connectors, such as a right angle ball grid array connector or a mezzanine BGA connector. Plastic or other suitable dielectric material may be used. The connector is preferably devoid of internal and external shields, but shields may also be added. Crosstalk should be in to a range of about six percent or less a signal rise times of about 200 to 35 picoseconds. The connector also preferably has an impedance of 100±10 Ohms or 85±10 Ohms.

Additional features and advantages of the invention will be made apparent from the following detailed description of illustrative embodiments that proceeds with reference to the accompanying drawings.

DETAILED DESCRIPTION OF ILLUSTRATIVE EMBODIMENTS

Figure 1A:
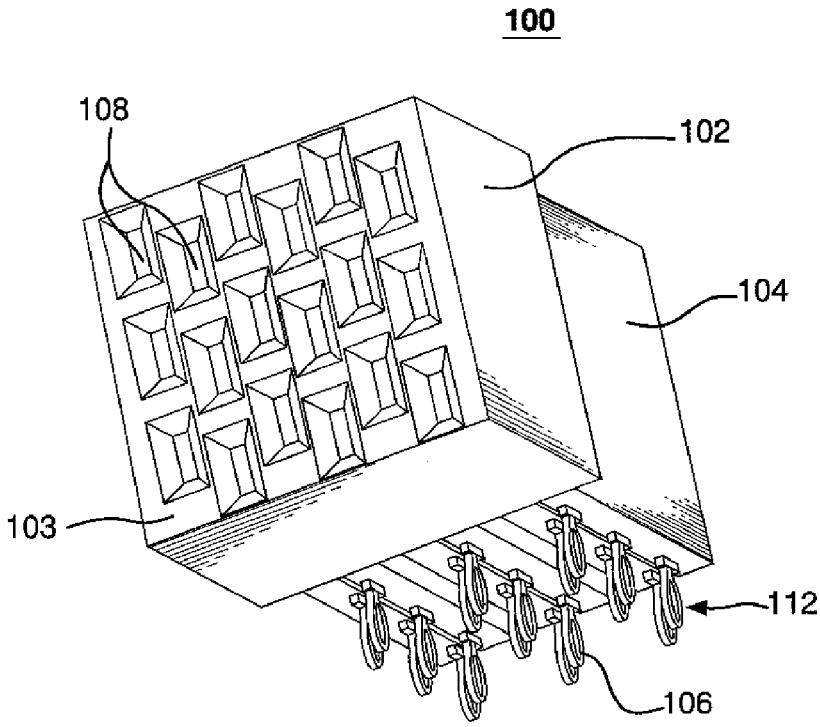
FIGS. 1A and 1B depict perspective views of an exemplary electrical connector according to an embodiment.
Figure 1B:
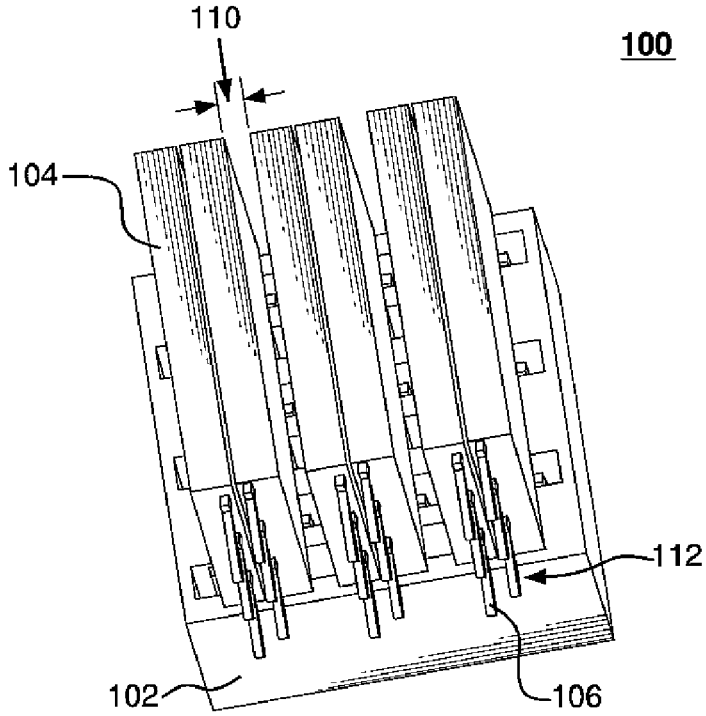

FIGS. 1A and 1B depict perspective views of high-density orthogonal connector 100 having electrical contacts 112, mating interface housing 102 and one or more lead portion housing 104. Connector 100 may be a female, or receptacle, connector. Connector 100 may be a right-angle connector and may be implemented in either orthogonal or non-orthogonal printed circuit board (PCB) applications. Connector 100 may also be a mezzanine connector or a header connector. Connector 100 may be devoid of any electrical shielding and/or ground contacts.

Face 103 of mating interface housing 102 may define a receptacle interface, with multiple slots 108 for receiving electrical contacts on a mating connector (not shown in FIGS. 1A and 1B). Slots 108 may be arranged in columns. Each adjacent column of slots 108 may be offset from one another in the direction of the column. The backside of receptacle housing 102 may interface with one or more lead portion housings 104, which may be separated from one another by gap 110. Connector 100 may be mounted to a PCB (not shown in FIGS. 1A and 1B) via terminal ends 106, which may extend from the bottom of lead portion housing 104. Connector 100 may be mounted to the PCB via any suitable technology, such as surface mount technology (SMT), solder ball grid array, press fit, compression mount, and the like.

Figure 2A:
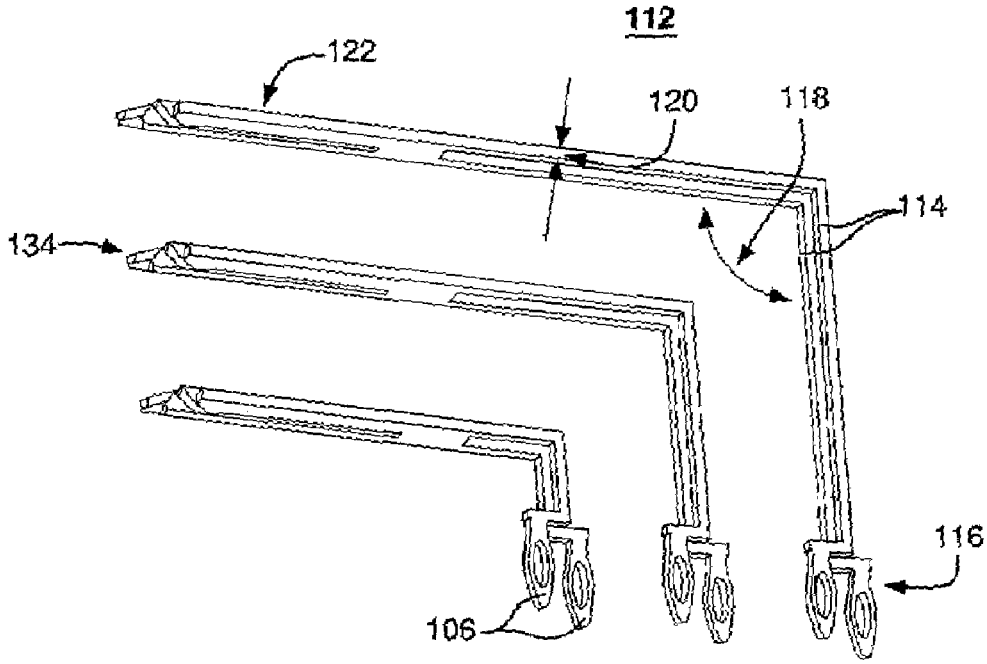
FIGS. 2A and 2B depict perspective views of an exemplary electrical contact arrangement within the electrical connector shown in FIGS. 1A and 1B.
Figure 2B:
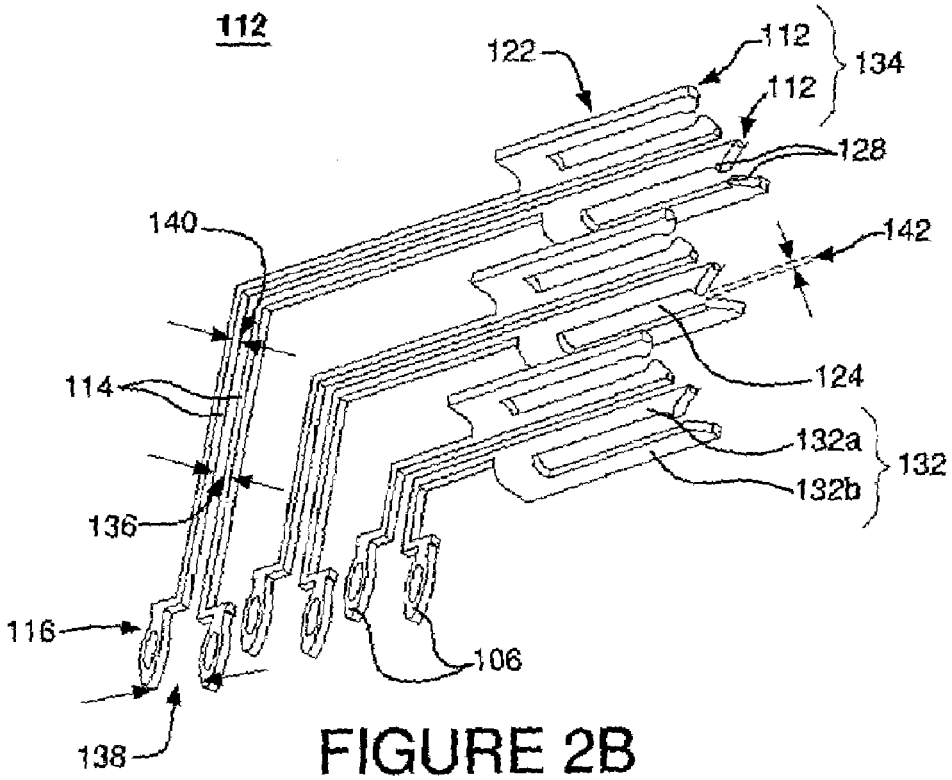

FIGS. 2A and 2B depict perspective views of electrical contacts 112 without mating interface housing 102 and lead portion housing 104. Electrical contact 112 may include mating interface 122, lead portion 114 and base portion 116. Mating interface 122 may include tines 132*a* and 132*b*, which may form tine 132. Tines 132*a* and 132*b* may define slot 124. Lead portion 114 and at least a portion of tine 132 may define a first plane and tine 132*b* may define a second plane. The second plane may be perpendicular to and offset from the first plane. Thus, the transition between tines 132*a* and 132*b* within mating interface 122 may be defined by transition portion 126, which may be a radius. For example, mating interface 122 may be twisted axially along a portion of tine 132*a* such that the second plane is rotated 90 degrees with respect to the first plane, resulting in the second pane being substantially perpendicular to and offset from the first plane. As shown in FIGS. 2A and 2B, adjacent electrical contacts 112 may form contact pair 134. At least a portion of tine 132*b* of an adjacent electrical contact 112 in contact pair 134 may define a third plane. Mating interfaces 122 in contact pair 134 may be twisted axially in opposite directions. Thus, the second plane and the third plane may be substantially parallel to each other and may be offset in opposite directions.

Tines 132*a* and 132*b* may also define opposing protrusion members 128, which may extend into slot 124. Protrusion members 128 of mating interface 122 may define gap 142. It will be appreciated that mating interface 122 has some ability to flex. Thus, gap 142 may be smaller than the width of a corresponding male contact (not shown in FIGS. 2A and 2B) when mating interface 122 is not engaged with the male contact and may enlarge when mating interface 122 receives the male contact. Therefore, protrusion members 128 may exert a force against each opposing side of the male contact, thereby mechanically and electrically coupling the mating interface 122 to the male contact. Furthermore, such force is preferably applied at the same point on opposing sides of the male contact such that mating interface 122 may exert minimal torque on the male contact.

Lead portion 114 may connect mating interface 122 and base portion 116. As noted above, connector 100 may be a right-angle connector. Thus, lead portion 114 may include angle 118, which may be substantially equal to 90 degrees or more. It will be appreciated that lead portion 114 may include any number of angles at various degrees. Base portion 116 may jog away from lead portion 114. As shown in FIGS. 2A and 2B, base portion 116 may extend perpendicularly from lead portion 114. Base portion 116 may include terminal end 106, which may interface with a PCB (not shown in FIGS. 2A and 2B). As shown in FIGS. 2A and 2B, terminal ends 106 may be offset from and extend in substantially the same direction as at least a portion of lead portion 114.

Adjacent electrical contacts 112 may form contact pair 134, which may be a differential signal pair of electrical contacts, a single-ended signal contact, a ground contact, two single ended signal contacts, or two ground contacts. Lead portions 114 in contact pair 134 may be in parallel planes. In addition, base portions 116 of electrical contacts 112 in contact pair 134 may extend perpendicularly from lead portions 114 in equal and opposite directions. Thus, the total length of electrical contacts 112 in contact pair 134 (i.e., the distance between the end of mating interface 122 and terminal end 106) is preferably substantially the same, thereby minimizing signal skew between electrical contacts 112 in contact pair 134.

Lead portions 114 may have a width 140 and a height 120. Height 120 may be greater than width 140 such that the broadside of lead portions 114 in contact pair 134 may be adjacent to one another. Electrical contacts 112 in contact pair 134 may be separated by distance 136. Width 140, height 120 and distance 136 may remain constant along the length of electrical contacts 112 in contact pair 134, thereby maintaining a constant differential impedance profile between electrical contacts 112 in contact pair 134 for a given dielectric such as air or plastic. For example, the distance 136 may be related to height 120 and the type of dielectric material. In addition, terminal ends 106 of base portions 116 in contact pair 134 may be offset by distance 138, which may be perpendicular to distance 136. Offset distance 138 may be varied to match the differential impedance of the connector PCB footprint.

Figure 3:
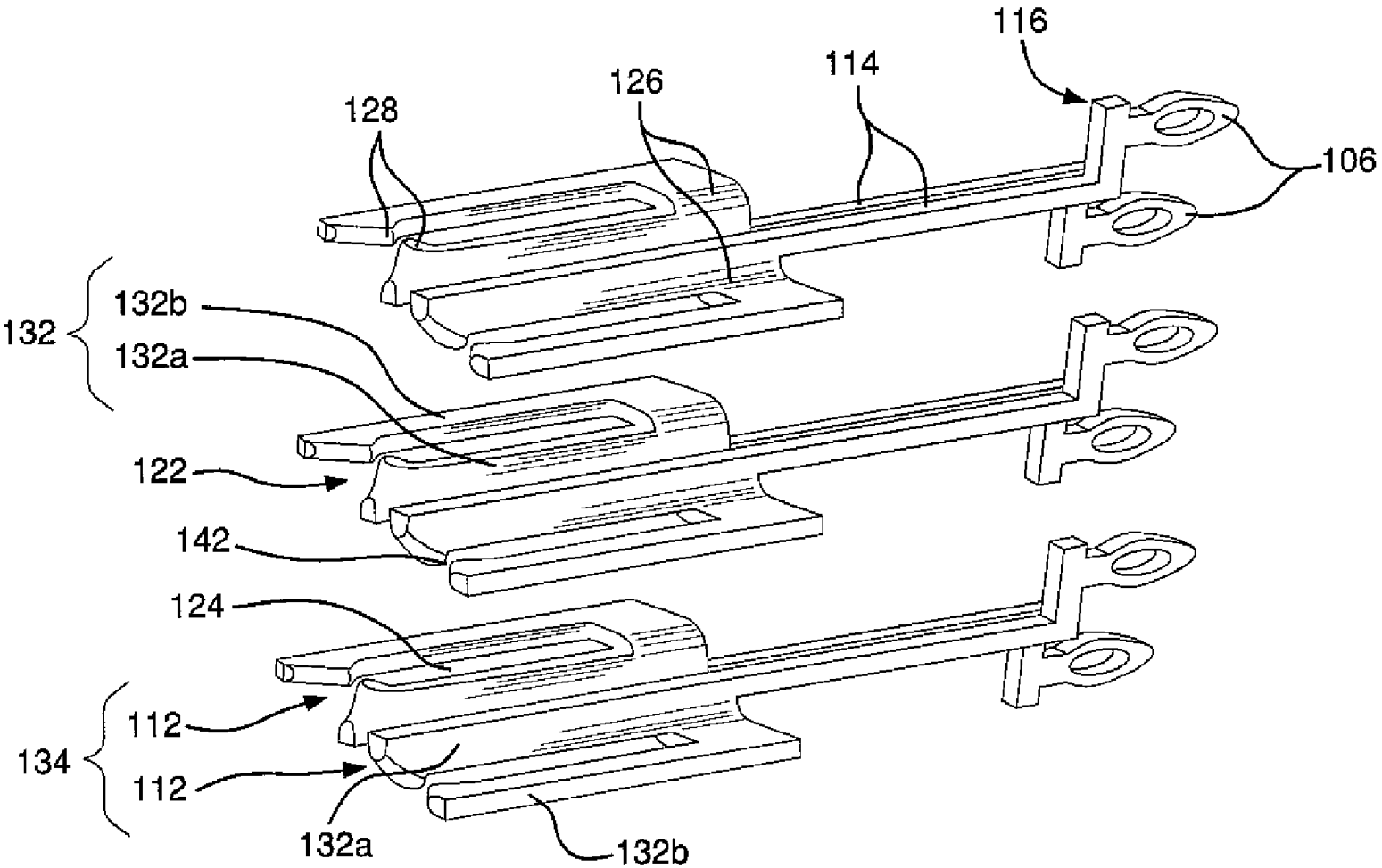
FIG. 3 depicts a perspective view of another exemplary electrical contact arrangement within an alternative embodiment of the electrical connector.

FIG. 3 depicts a perspective view of electrical contacts 112 according to alternative embodiment. As shown in FIG. 3, electrical contact 112 may include mating interface 122, lead portion 114 and base portion 116. Lead portion 114 may connect mating interface 122 and base portion 116. As noted above, connector 100 may be a mezzanine connector. Thus, as shown in FIG. 3, lead portion 114 may be substantially straight. Base portion 116 may include terminal end 106, which may interface with a PCB (not shown in FIG. 3). Terminal ends 106 may be offset from and extend in substantially the same direction as at least a portion of lead portion 114. The electrical contacts 112 may be assembled so that the same surfaces of the lead portion 114 face one another.

Mating interface 122 of each electrical contact 112 may include tines 132*a* and 132*b*, which may form cross-sectional L-shaped tine 132. Tines 132*a* and 132*b* may define slot 124. As shown, lead portion 114 and at least a portion of tine 132*a* may define a first plane and at least a portion of tine 132*b* defines a second plane. The second plane may be substantially perpendicular to the first plane. Thus, the transition between tines 132*a* and 132*b* within mating interface 122 may be defined by transition portion 126, which may include a radius as shown. For example, mating interface 122 may be twisted along the axial length of tine 132*a* and a portion of tine 132*b* such that the tines 132*a* and 132*b* are rotated out of (e.g., rotated substantially 90 degrees with respect to) the first plane.

As shown in FIG. 3, adjacent electrical contacts 112 may form contact pair 134. At least a portion of tine 132*b* of an adjacent electrical contact 112 in contact pair 134 may define a third plane. Thus, the second plane and the third plane may be substantially parallel to each other and perpendicular to the first plane.

In one embodiment, the mating interfaces 122 include tuning fork contacts that are bent over. Respective differential signal pairs of the turning fork contacts 134 may be broadside coupled to one another. The mating interfaces 122 of the electrical contacts 112 within each contact pair 134 may be offset. The terminal ends 106 of the electrical contacts within each contact 134 may also be offset.

Tines 132*a* and 132*b* may also define opposing protrusion members 128, which may extend into slot 124. Protrusion members 128 of mating interface 122 may define a gap 142. It will be appreciated that mating interface 122 has some ability to flex. Thus, gap 142 may be smaller than the width of a corresponding male contact (not shown in FIG. 3) when mating interface 122 is not engaged with the male contact and may enlarge when mating interface 122 receives the male contact. Therefore, protrusion members 128 may exert a force against each opposing side of the male contact, thereby mechanically and electrically coupling the mating interface 122 to the male contact. Furthermore, such force may be applied at the same point on opposing sides of the male contact such that mating interface 122 may exert minimal torque on the male contact.

As shown in FIG. 3, adjacent electrical contacts 112 may form contact pair 134, which may be a differential signal pair of electrical contacts, a single-ended signal contacts, ground contacts, or any combination thereof. Lead portions 114 in contact pair 134 may be coplanar or coincident. In addition, base portions 116 of electrical contacts 112 in contact pair 134 may extend substantially perpendicularly from lead portions 114 in equal and opposite directions. Thus, the total length of electrical contacts 112 in contact pair 134 (i.e., the distance between the end of mating interface 122 and terminal end 106) may be substantially the same, thereby minimizing signal skew between electrical contacts 112 in contact pair 134.

Figure 4A:
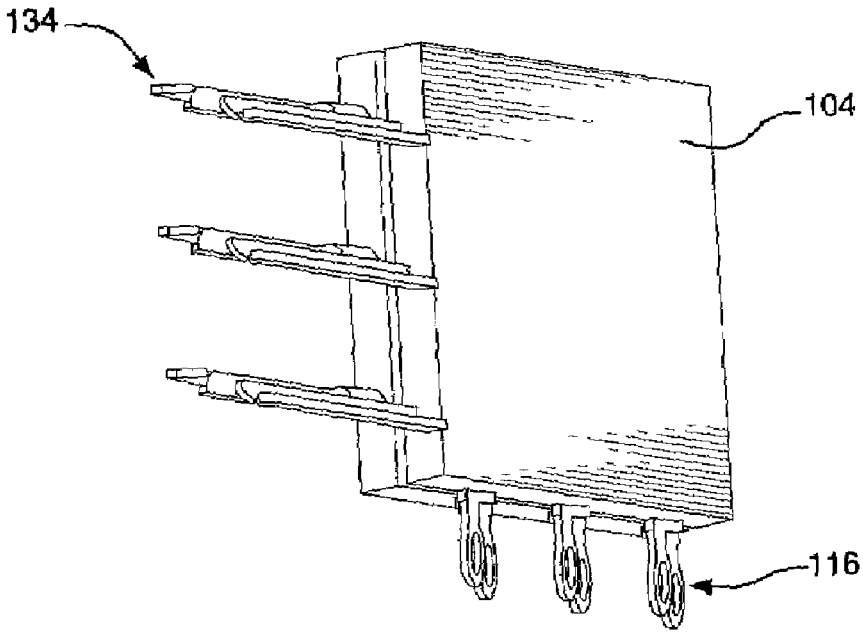
FIGS. 4A and 4B depict perspective views of a portion of the electrical connector shown in FIGS. 1A and 1B without a mating interface housing.
Figure 4B:
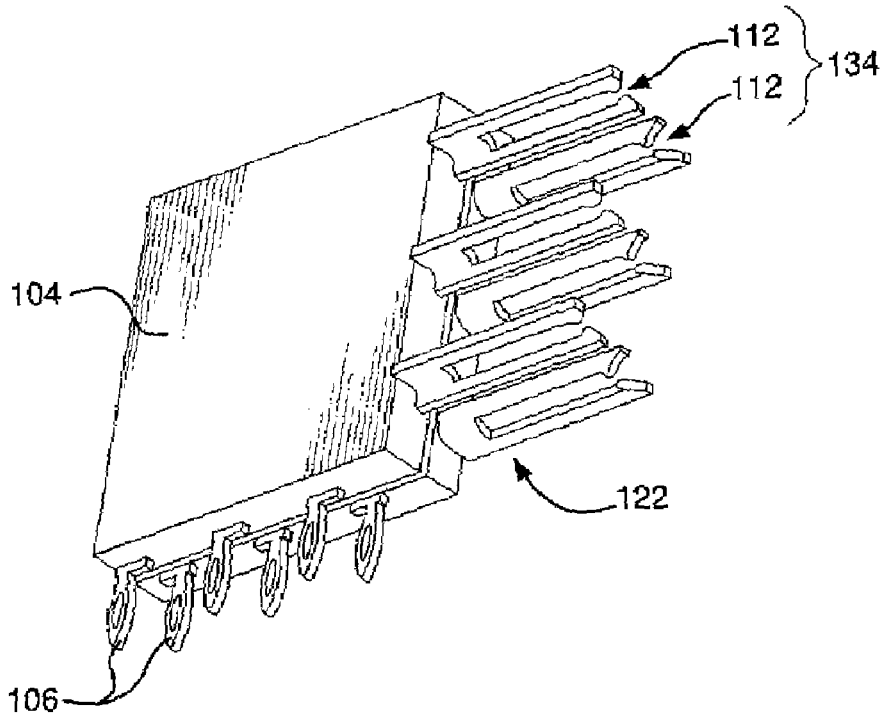

FIGS. 4A and 4B depict perspective views of exemplary connector 100 without mating interface housing 102. As shown in FIGS. 4A and 4B, lead portion housing 104 may contain two columns of electrical contacts 112 having mating interfaces 122 that are offset from one another in the direction of the column. The two columns, together, may define a single column of contact pairs 134. It will be appreciated that lead portion housing 104 may include any number of columns and/or rows of electrical contacts 112 or contact pairs 134. Lead portion housing 104 may include a dielectric material, such as plastic, that is overmolded onto lead portions 114. Offset tabs (not shown in FIGS. 4A and 4B) may be added between adjacent lead portions 114 in each contact pair 134 to fix their relative position with respect to one another during the overmolding process. Mating interfaces 122 of electrical contacts 112 may extend from the front of lead portion housing 104. As noted above, connector 100 may be a right-angle connector. Thus, base portions 116 may extend from the bottom of lead portion housing 104. It will be appreciated that connector 100 may also be a mezzanine connector. Thus, base portions 116 may also extend from the back of lead portion housing 104.

Figure 4D:
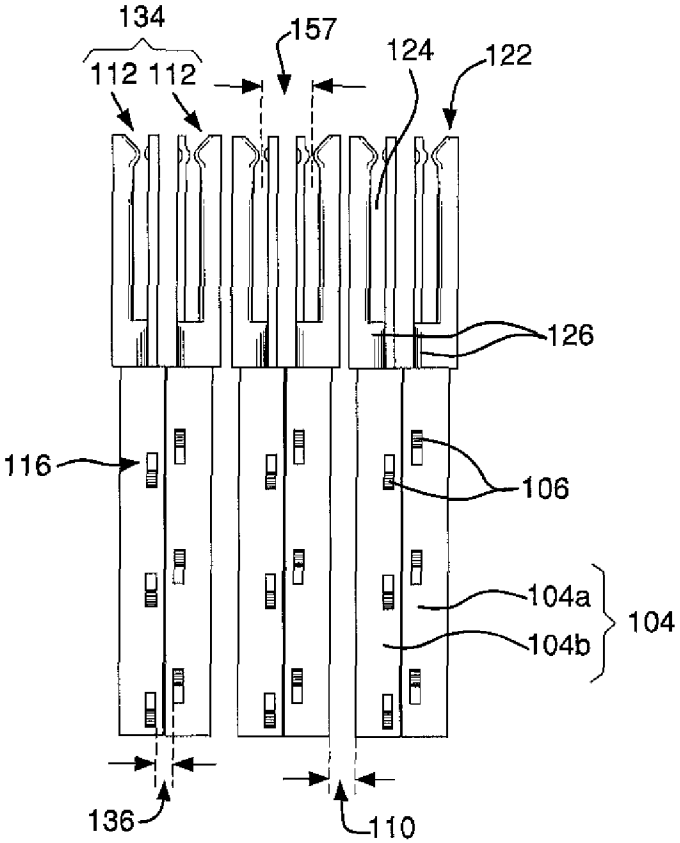
FIGS. 4C and 4D depict front and bottom views, respectively, of the electrical connector of FIGS. 1A and 1B without the mating interface housing.
Figure 4C:
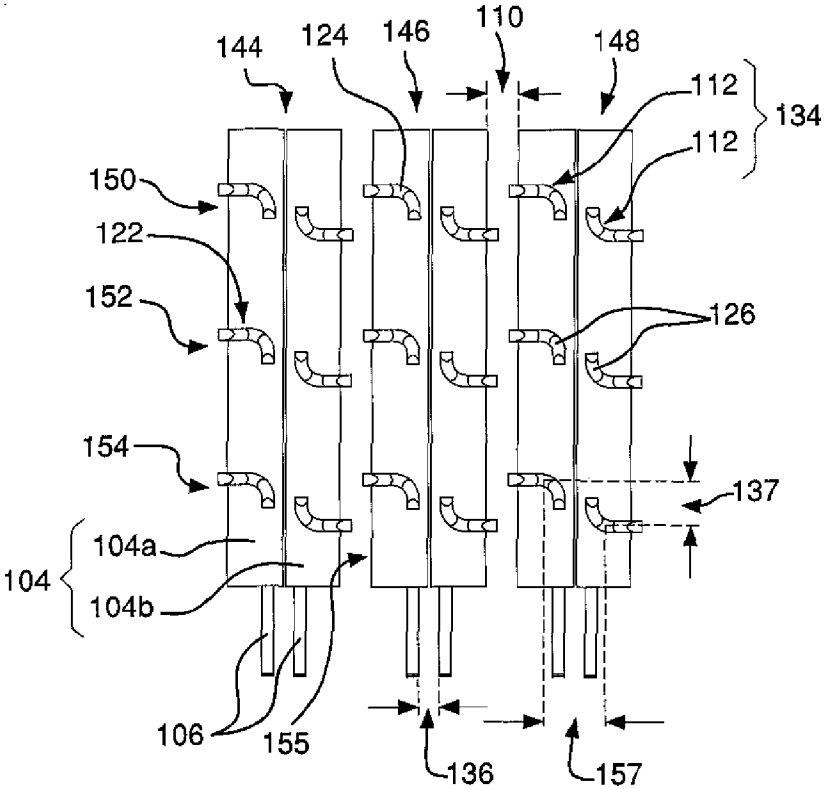

FIGS. 4C and 4D depict front and bottom views, respectively, of connector 100 without mating interface housing 102. As shown in FIGS. 4C and 4D, connector 100 may include contact pair columns 144, 146 and 148 and contact pair rows 150, 152 and 154, although any number of columns and/or rows of contact pairs 134 would be consistent with an embodiment. As noted above, lead portion housing 104 may include a dielectric material that is overmolded onto lead portions 114 of electrical contacts 112. As shown in FIG. 4C, lead portion housing 104 may include two sections, 104*a* and 104*b*, each overmolded onto a single column of electrical contacts 112. Lead portion housings 104*a* and 104*b* may be secured together to form lead portions housing 104.

Adjacent electrical contacts 112 in contact pair columns (e.g., contact pair column 146 of FIG. 4C) may be separated by gap 136. In addition, each slot 124 in contact pair 134 may be offset by distance 137 in the direction of the column and by distance 157 in the direction of a row. Adjacent lead portion housings 104 may be separated by gap 110. As shown in FIGS. 4C and 4D, a portion of mating interface 122 may extend beyond edge 155 of lead portion housing 104 into gap 110.

Figure 5A:
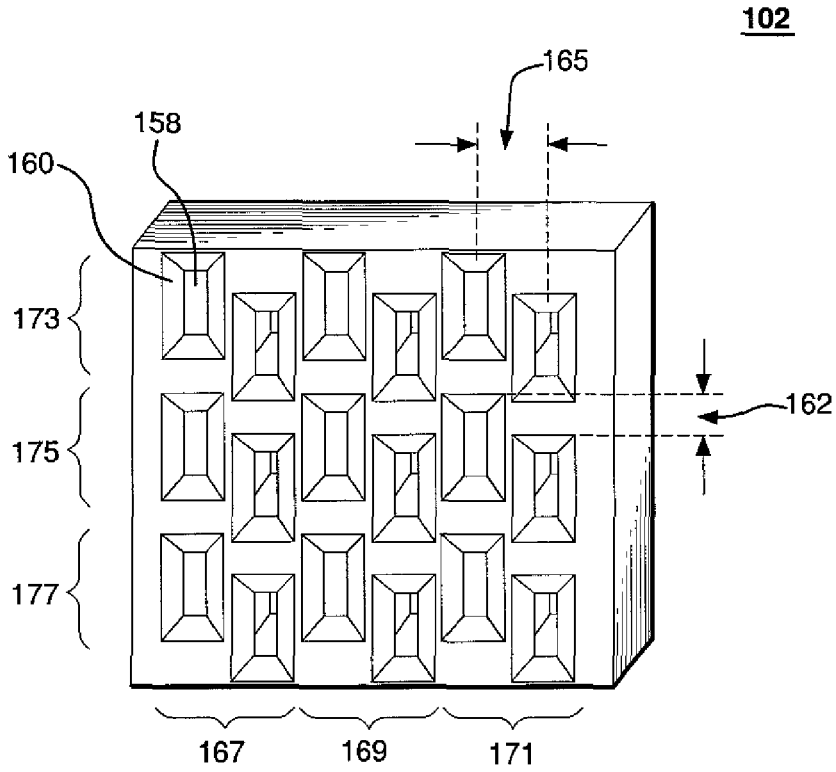
FIGS. 5A and 5B depict front and rear views, respectively, of the mating interface housing.
Figure 5B:
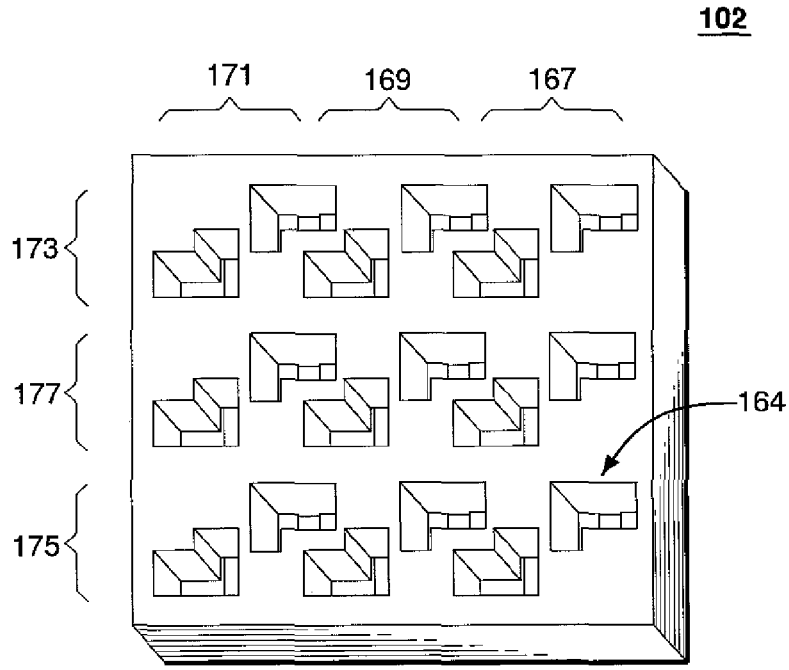

FIGS. 5A and 5B depict front and back views, respectively, of mating interface housing 102 without electrical contacts 112 and lead portion housing 104. As shown in FIG. 5A, the front side of mating interface housing 102 may include numerous vertical slots 158, each of which may be adapted to receive a corresponding male contact (not shown in FIG. 5A). For example, slot 158 may define a rectangular cross-section that is capable of receiving a male contact with a blade-shaped mating end. Slots 158 may be arranged in columns and rows of contact pairs 134, such as columns 167, 169, 171 and rows 173, 175, 177. Columns 167, 169 and 171 may correspond to contact pair columns 144, 146 and 148, respectively. Rows 173, 175 and 177 may correspond to contact pair rows 150, 152 and 154, respectively.

Slot 158 may define recess 160, which may serve as a guide to facilitate the coupling between mating interface 122 and a corresponding male contact. Each adjacent column of slots 158 may be offset from one another in the direction of the column by offset distance 162, which may be equal to distance 137 (i.e., the distance between slots 124 in contact pair 134 in the direction of a column). Adjacent slots 158 along a row may be separated from one another by distance 165, which may equal offset distance 157 (i.e., the distance between slots 124 in contact pair 134 in the direction of a row).

As shown in FIG. 5B, the back side of mating interface housing 102 may include numerous cavities 164, each of which may be adapted to receive mating interface 122. For example, cavity 164 may define a substantially L-shaped cross-section. The depth of cavity 164 may depend on the depth of mating interface housing 102 and/or the length of mating interface 122. Each cavity 164 may include a retention member (not shown in FIGS. 5A and 5B) for securing lead portion housing 104 to mating interface housing 102. It will be appreciated that any commonly available retention member is consistent with an embodiment.

Figure 6A:
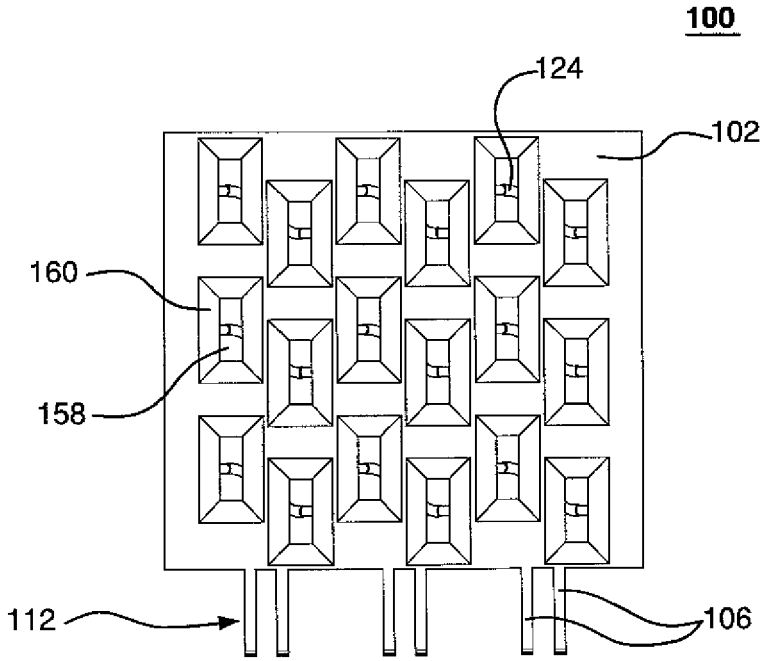
FIGS. 6A and 6B depict front and bottom views, respectively, of the electrical connector of FIGS. 1A and 1B.
Figure 6B:
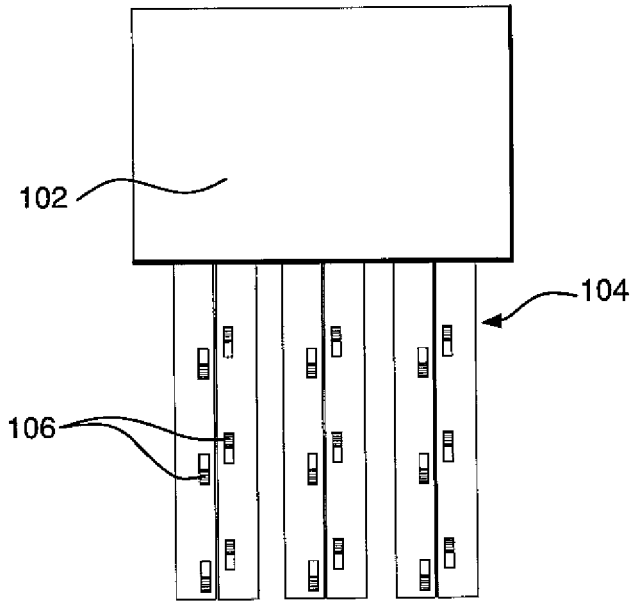

FIGS. 6A and 6B depict front and bottom views, respectively, of exemplary connector 100 with electrical contacts 112, mating interface housing 102 and lead portion housing 104. As shown in FIG. 6A, each slot 124 of mating interface 122 may be accessible via slot 158 on the front of mating interface housing 102. As shown in FIG. 6B, mating interfaces 122 may be inserted through the back of mating interface housing 102 into their respective cavity 164 and the lead portion housing 104 secured via the retention members (not shown in FIGS. 6A and 6B). Thus, the back of mating interface housing 102 may interface with the front of lead portions housings 104 and may be secured together, for example, via retention members.

Figure 7A:
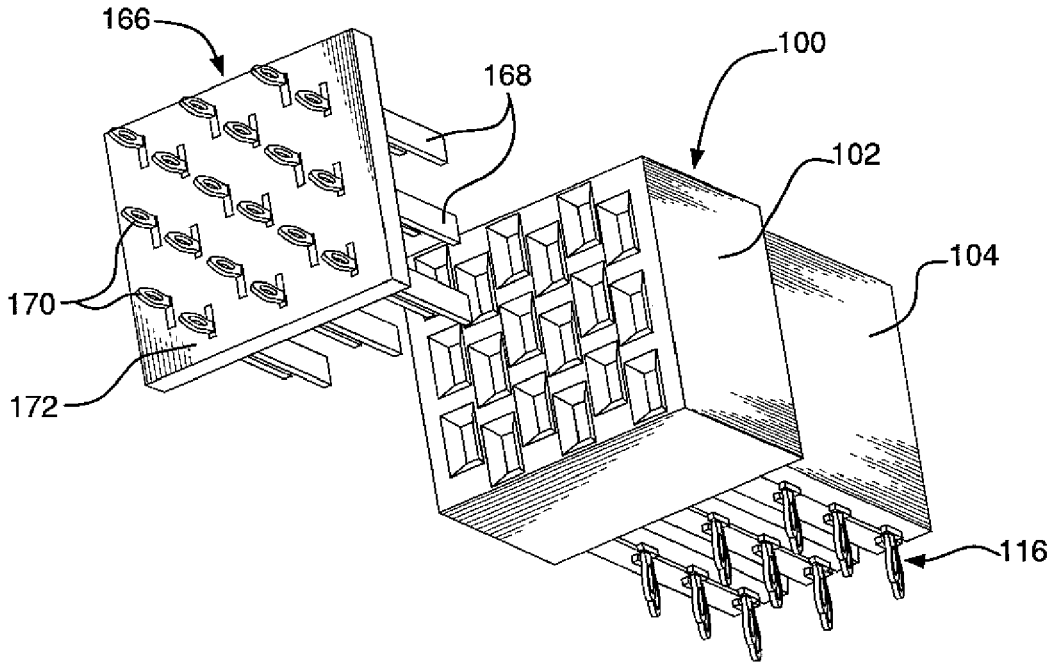
FIGS. 7A and 7B depict perspective views of an exemplary header connector capable of mating with the electrical connector shown in FIGS. 1A and 1B.
Figure 7B:
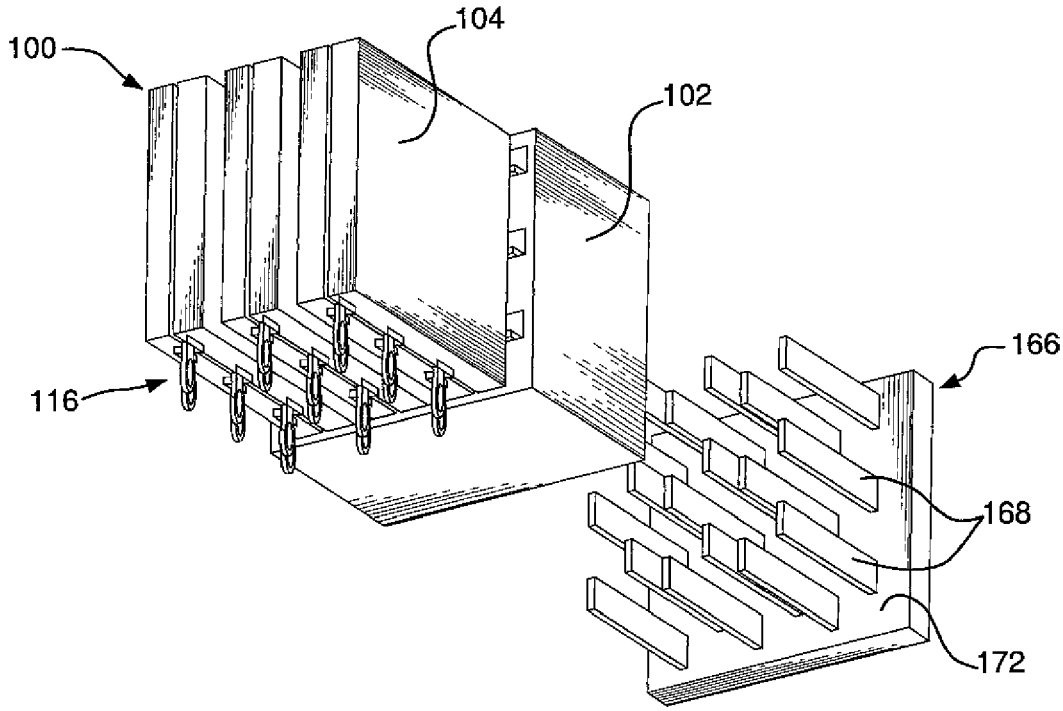

FIGS. 7A and 7B depict perspective views of exemplary connector 100 and corresponding exemplary header connector 166. Header connector 166 may include blade-shaped mating ends 168, terminal ends 170 and dielectric housing 172. Connector 100 and header connector 166 may be coupled to a daughter card and a backplane (not shown in FIGS. 7A and 7B), respectively. Blade-shaped mating ends 168 may be arranged in columns. Dielectric housing 172 may be overmolded onto blade-shaped mating ends 168. Alternatively, blade-shaped mating ends 168 may be stitched into dielectric housing 172. Terminal ends 170 of each adjacent column of blade-shaped mating ends 168 may be offset in opposing directions such that terminal ends 170 define an orthogonal footprint.

Adjacent columns of blade-shaped mating ends 168 may be offset from one another in the direction of the column. The amount of offset between adjacent columns of blade-shaped mating ends 168 in connector 166 may be equal to distance 137 (i.e., the vertical distance between slots 124 of contact pair 134 in connector 100). In addition, the distance between adjacent columns of blade-shaped mating ends 168 in header connector 166 may be equal to distance 157 (i.e., the horizontal distance between slots 124 of contact pair 134 in connector 100).

Figure 8A:
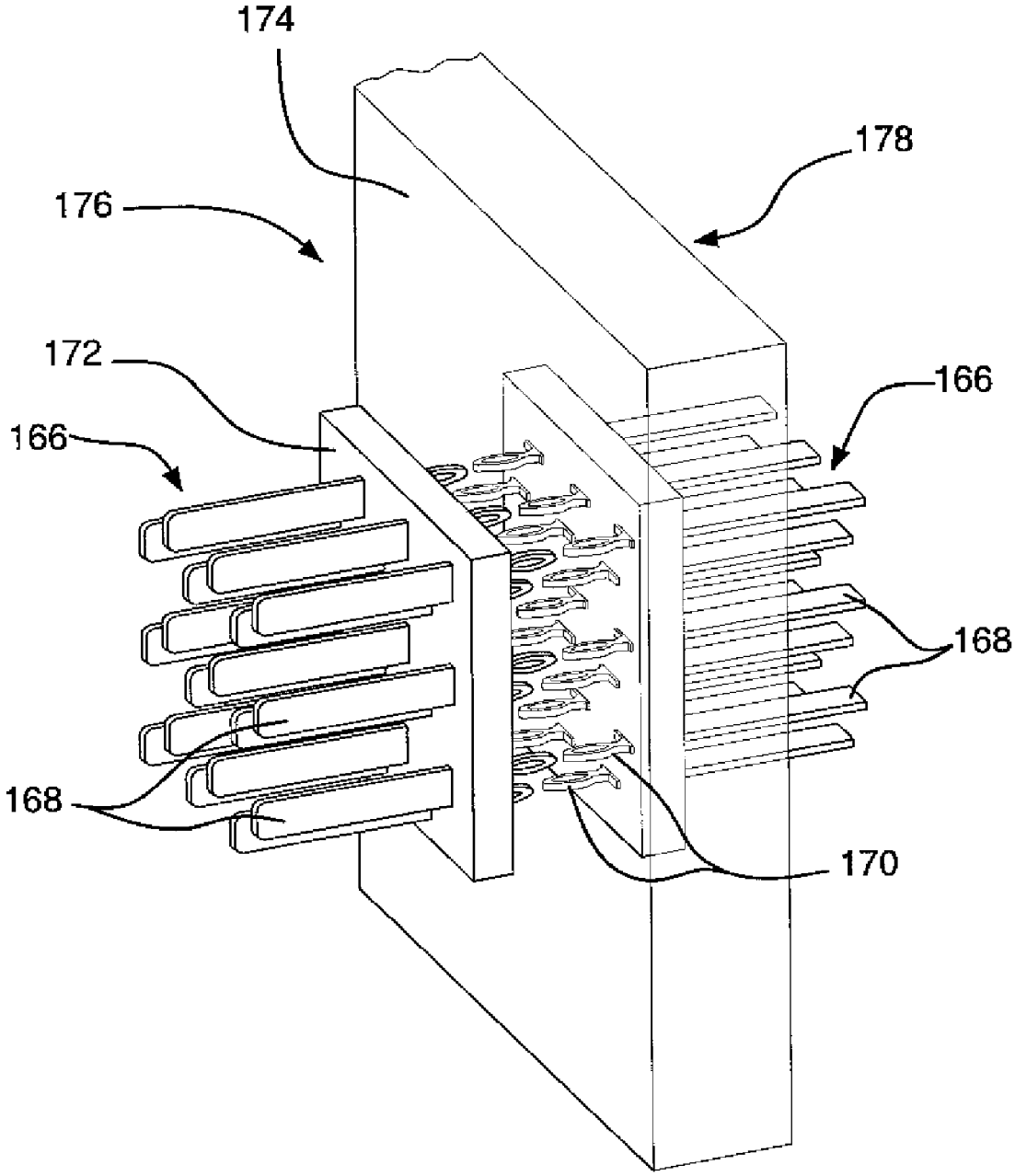
FIG. 8A depicts a perspective view of the header connector coupled to opposing sides of a midplane.

FIG. 8A depicts header connector 166 in an exemplary orthogonal connector assembly. In particular, header connector 166 may be coupled to opposing sides 176 and 178 of midplane 174. As shown in FIG. 8A, header connector 166 on side 178 of midplane 174 may be rotated 90 degrees with respect to header connector 166 on side 176 of midplane 174. As noted above, terminal ends 170 of each adjacent column of blade-shaped mating ends 168 in header connector 166 may be arranged in opposing directions such that terminal ends 170 define an orthogonal interface. Thus, the via hole configurations (not shown in FIG. 8A) on opposing sides 176 and 178 of midplane 174 may be substantially the same.

Figure 8B:
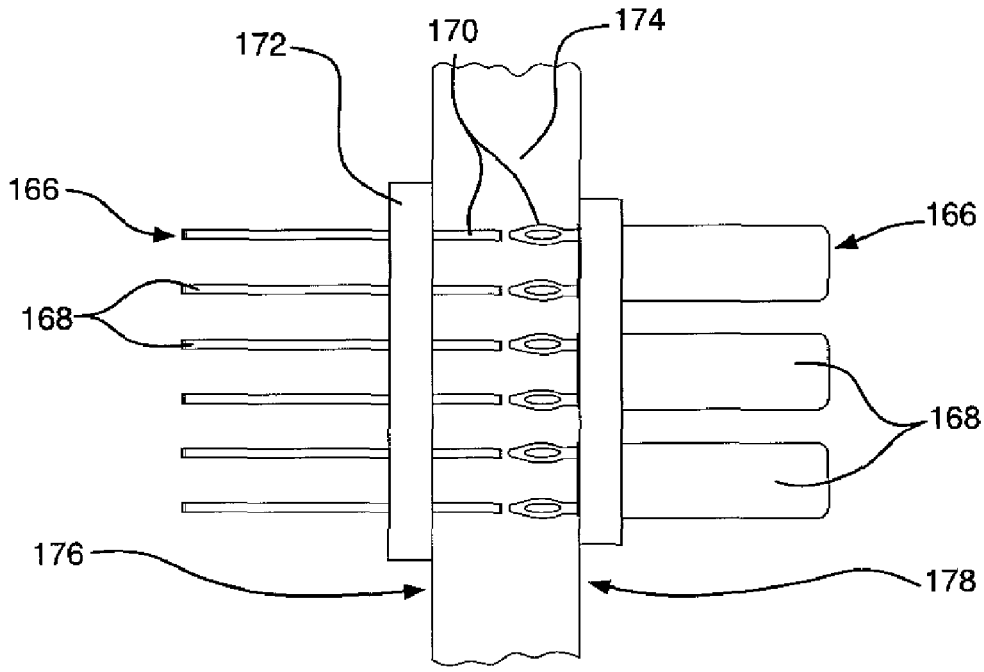
FIGS. 8B and 8C depict top and side views, respectively, of the header connector coupled to opposing sides of the midplane.
Figure 8C:
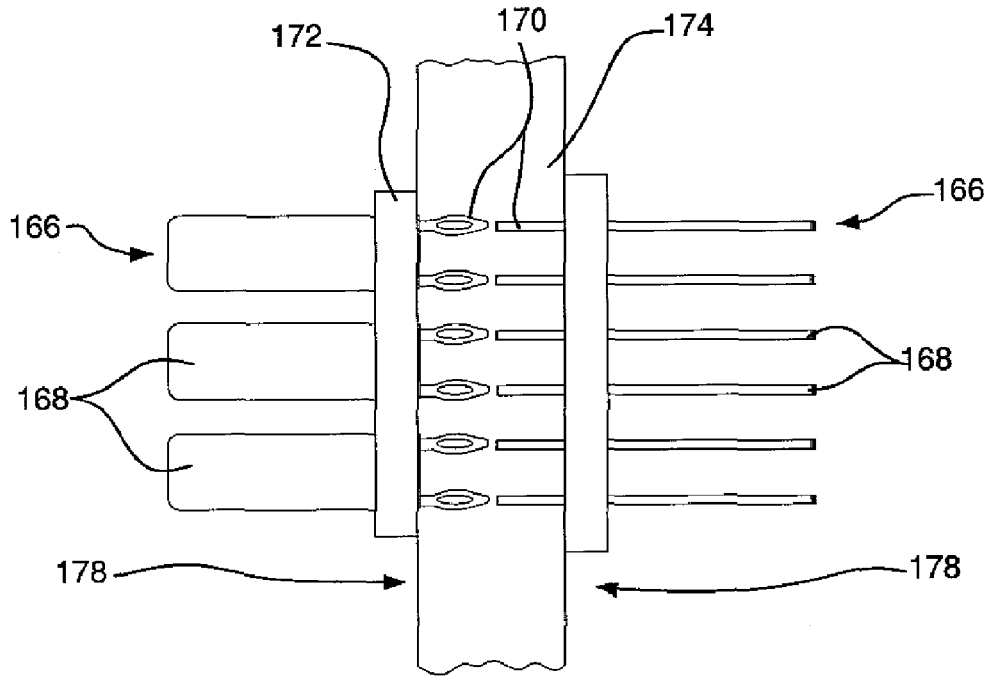

For example, FIGS. 8B and 8C depict top and side views, respectively, of header connector 166 in an exemplary orthogonal connector assembly. As shown in FIG. 8B, columns of terminal ends 170 in header connector 166 on side 176 of midplane 174 may be aligned with columns of terminal ends 170 in connector 166 on side 178. As shown in FIG. 8C, rows of terminal ends 170 in header connector 166 on side 176 may also be aligned with rows of terminal ends 170 in header connector 166 on side 178. Thus, header connector 166 on side 178 may be rotated 90 degrees with respect to header connector 166 on side 176 without requiring different via hole configurations on opposing sides 176 and 178 of midplane 174.

Figure 9A:
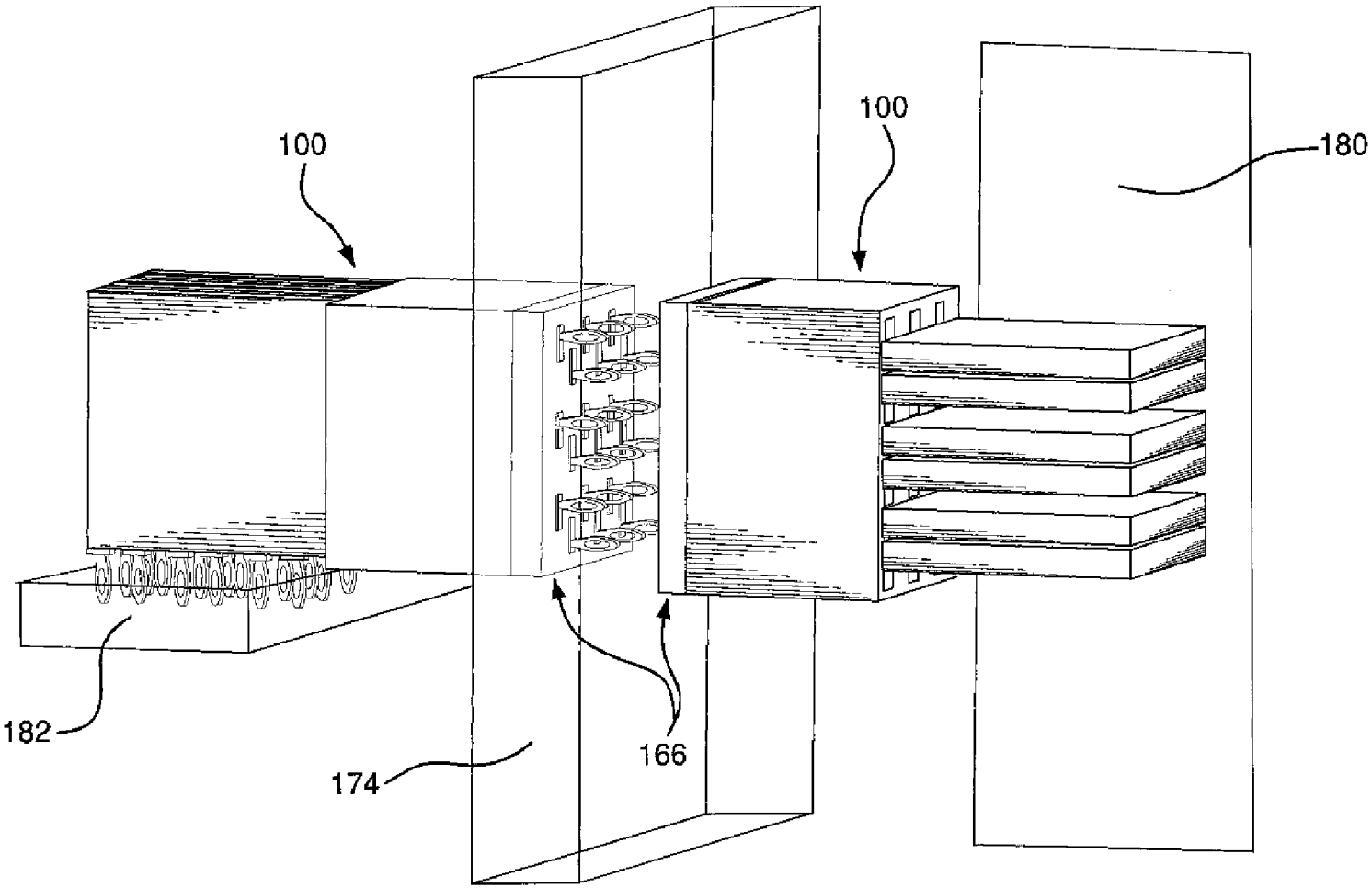
FIG. 9A is a perspective view of the electrical connector shown in FIGS. 1A and 1B mated with the header connectors on the midplane.

FIG. 9A depicts a perspective view of an orthogonal connector assembly according to an embodiment. Header connectors 166 may be disposed on opposing sides of midplane 174. Header connectors 166 may be rotated 90 degrees with respect to one another. Each header connector 166 may interface with connector 100, which may be a right-angle connector. As shown in FIG. 9A, connectors 100 may also be rotated 90 degrees with respect to one another. Thus, connectors 100 may electrically couple daughter cards 180 and 182, for example, that have planar surfaces that are orthogonal to one another.

Figure 9B:
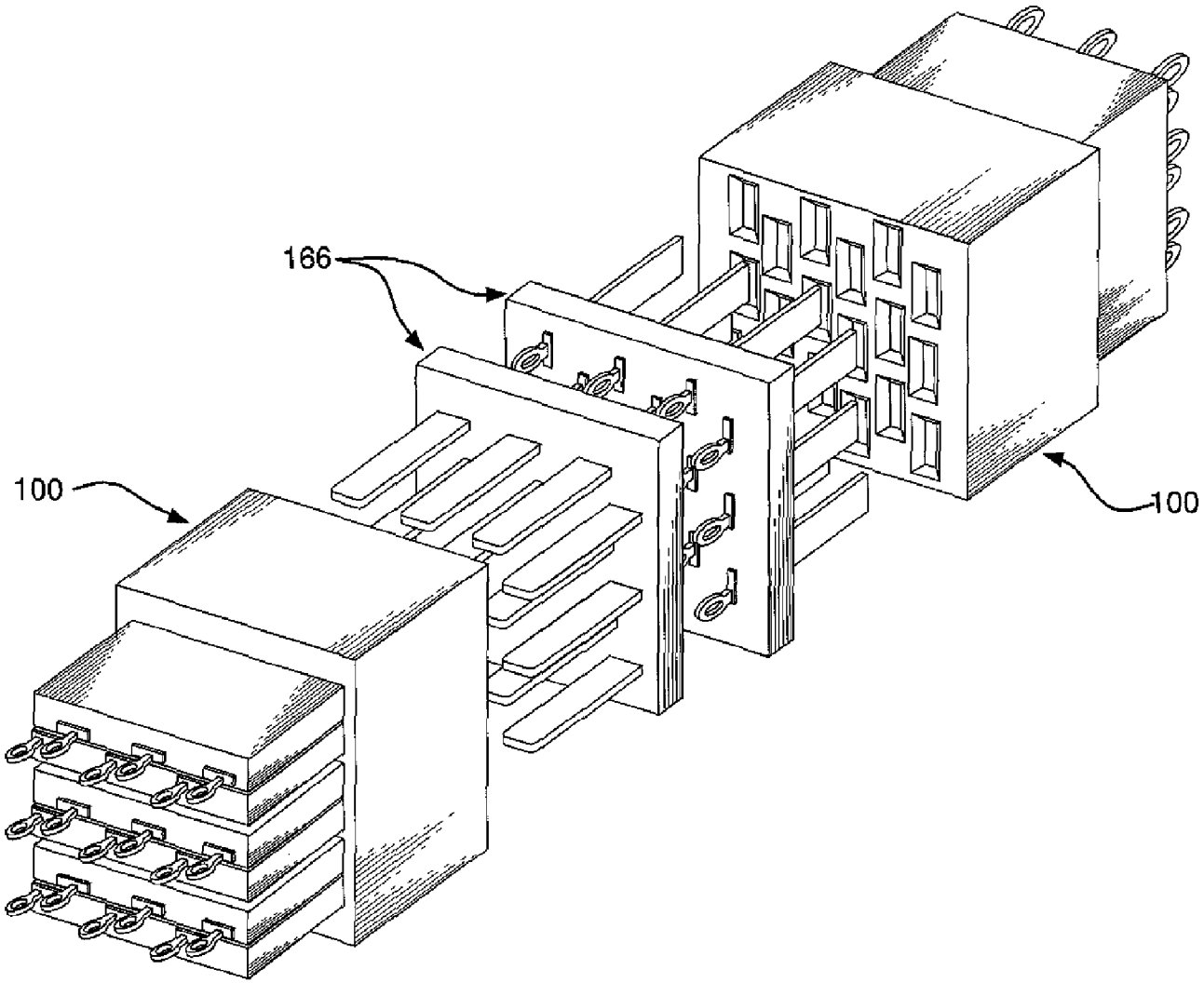
FIG. 9B is a perspective view of an alternative embodiment of the electrical connector having an electrical contact arrangement shown in FIG. 3 with the header connectors.

FIG. 9B depicts a perspective view of mezzanine connector assembly according to an alternative embodiment. In particular, FIG. 9A depicts header connectors 166 disposed on opposing sides of midplane 174 (not shown in FIG. 9B). Header connectors 166 may be rotated 90 degrees with respect to one another. Each header connector 166 may interface with connector 100, which may be a mezzanine connector. As shown in FIG. 9B, connectors 100 may also be rotated 90 degrees with respect to one another. Thus, connectors 100 may electrically couple daughter cards 180 and 182 (not shown in FIG. 9B), for example, with planar surfaces that are parallel to one another.

While systems and methods have been described and illustrated with reference to specific embodiments, those skilled in the art will recognize that modification and variations may be made without departing from the principles described above and set forth in the following claims.

Accordingly, reference should be made to the following claims as describing the scope of disclosed embodiments.

What is claimed is:

1. A pair of electrical contacts, comprising:

a first electrical contact, comprising:

a first lead portion that extends along a first plane; and a first mating interface extending from the first lead portion, a first portion of the first mating interface lying in the first plane and a second portion of the first mating interface lying in a second plane transverse to the first plane, wherein the second portion of the first mating interface is offset from the first lead portion in a first direction; and a second electrical contact, comprising:

a second lead portion that extends parallel to the first lead portion; and a second mating interface extending from the second lead portion, a first portion of the second mating interface lying in a third plane that is parallel to the second plane and transverse to the first plane, wherein the first portion of the second mating interface is offset from the second lead portion in a second direction that is away from the first direction.

2. The pair of electrical contacts of claim 1, wherein a third portion of the first mating interface is twisted axially in a third direction from the first lead portion and a second portion of the second mating interface is twisted axially in a fourth direction opposite from the second lead portion.

3. The pair of electrical contacts of claim 1, wherein the first electrical contact further comprises a first base portion extending substantially perpendicularly from the first lead portion at an end opposite from the first mating interface and the second electrical contact further comprises a second base portion extending substantially perpendicularly from the second lead portion at an end opposite from the second mating interface.

4. The pair of electrical contacts of claim 3, wherein the first base portion comprises a first terminal end and the second base portion comprises a second terminal end, and wherein the first terminal end is offset from the first lead portion in a fifth direction and the second terminal end is offset from the second lead portion in a sixth direction.

5. The pair of electrical contacts of claim 4, wherein the fifth and sixth directions are substantially opposite directions.

6. The pair of electrical contacts of claim 1, wherein the first electrical contact and the second electrical contact comprise a differential signal pair.

7. The pair of electrical contacts of claim 1, wherein the first mating interface of the first electrical contact is L-shaped in cross-section.

8. The pair of electrical contacts of claim 1, wherein corresponding surfaces of the lead portions of the first electrical contact and the second electrical contact face one another.

9. The pair of electrical contacts of claim 1, wherein the first mating interface comprises a first plurality of opposing tines that define a first slot and the second mating interface comprises a second plurality of opposing tines that define a second slot.

10. The pair of electrical contacts of claim 9, wherein the first plurality of tines are adapted to receive a first blade-shaped mating end and the second plurality of tines are adapted to receive a second blade-shaped mating end.

11. The pair of electrical contacts of claim 9, wherein the first plurality of tines further define a first plurality of opposing protrusion members and the second plurality of tines further define a second plurality of opposing protrusion members, and wherein the first plurality of opposing protrusion members and the second plurality of opposing protrusion members are adapted to exert minimal torque on the first blade-shaped mating end and the second blade-shape mating end, respectively.

12. The pair of electrical contacts of claim 1, wherein the first lead portion and the second lead portion define a first angle and a second angle, respectively.

13. The pair of electrical contacts of claim 1, wherein the first lead portion and the second lead portion are substantially straight.

14. The pair of electrical contacts of claim 1, further comprising a lead portion housing disposed about the first lead portion and the second lead portion, wherein the lead portion housing provides mechanical rigidity to hold the first electrical contact with respect to the second electrical contact.

15. The pair of electrical contacts of claim 14, wherein the lead portion housing comprises a dielectric material.

16. The pair of electrical contacts of claim 1, further comprising:

a lead portion housing disposed about the first electrical contact; and a second housing attached to the lead portion housing.

17. The pair of electrical contacts of claim 1, wherein said first electrical contact and said second electrical contact are symmetrical, wherein said second electrical contact is rotated 180 degrees relative to said first electrical contact.

18. The pair of electrical contacts of claim 17, wherein the second portion of the first electrical contact extends in a direction opposite from the first portion of the second electrical contact of the pair.

19. The pair of electrical contacts of claim 10, wherein the first and second pluralities of tines are adapted to contact opposing sides of the first and second blade-shaped mating ends, respectively.

20. The pair of electrical contacts of claim 1, wherein the first and second electrical contacts are housed in an electrical connector that defines an orthogonal footprint.

21. The pair of electrical contacts of claim 1, wherein the first and second electrical contacts are housed in an electrical connector that is devoid of grounds.

22. The pair of electrical contacts of claim 1, wherein the first and second electrical contacts are housed in an electrical connector having a crosstalk in a range of about six percent or less at signal rise times of about 200 to 35 picoseconds.

* * * * *